US010343432B2

(12) United States Patent
Sasaki

(10) Patent No.: US 10,343,432 B2
(45) Date of Patent: Jul. 9, 2019

(54) PRINTING APPARATUS WITH COOLING FAN

(71) Applicant: RISO KAGAKU CORPORATION, Tokyo (JP)

(72) Inventor: Naoki Sasaki, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/023,518

(22) Filed: Jun. 29, 2018

(65) Prior Publication Data

US 2019/0047306 A1 Feb. 14, 2019

(30) Foreign Application Priority Data

Aug. 10, 2017 (JP) ..... 2017-155013

(51) Int. Cl.
*B41J 29/377* (2006.01)

(52) U.S. Cl.
CPC ..... *B41J 29/377* (2013.01)

(58) Field of Classification Search
CPC ..... F24F 7/00; F24F 7/04; F24F 7/06; B41J 29/377
See application file for complete search history.

(56) References Cited

U.S. PATENT DOCUMENTS 9,152,127 B2 * 10/2015 Kawasumi ..... G03G 21/206

FOREIGN PATENT DOCUMENTS

| | | | |
|---|---|---|---|
| JP | 10-268735 | * 10/1998 | ..... G03G 21/20 |
| JP | 2003-076253 | * 3/2003 | ..... G03G 21/20 |
| JP | 2011-22310 | 2/2011 | |

OTHER PUBLICATIONS

English translation of JP 2011-022310, published on Feb. 2011. (Year: 2011).*

* cited by examiner

*Primary Examiner* — Huan H Tran
(74) *Attorney, Agent, or Firm* — Greenblum & Bernstein, P.L.C.

(57) ABSTRACT

A printing apparatus includes: a case having a door; a duct installed on an inner side of the door in the case and communicating with an outside of the case; a cover installed in the case and having an opening, the opening allowing an inside of the case and the outside of the case to communicate with each other via the duct of the door being closed; a fan configured to perform at least one of drawing of air into the case or exhausting of air from the case via the opening and the duct with the door being closed; and a shutter configured to open the opening during drive of the fan and close the opening while the door is open.

3 Claims, 17 Drawing Sheets

PRINTING APPARATUS WITH COOLING FAN

CROSS REFERENCE TO RELATED APPLICATION

This application is based upon and claims the benefit of priority from the prior Japanese Patent Application No. 2017-155013, filed on Aug. 10, 2017, the entire contents of which are incorporated herein by reference.

BACKGROUND

1. Technical Field

The disclosure relates to a printing apparatus which performs printing on a print medium.

2. Related Art

A printing apparatus with a fan for cooling an inside of the apparatus is known.

Japanese Patent Application Publication No. 2011-22310 discloses a printing apparatus including a cover (exterior cover) in which air passage holes are formed, a fan which is arranged behind the air passage holes of the cover, and an opening/closing portion (front cover) which can be opened and closed and in which air passage holes are formed.

The opening/closing portion of the printing apparatus includes an inner cover and an outer cover, and a space between the inner cover and the outer cover forms an air passage portion. A connection portion between the inner cover and the outer cover is provided with openings which allow the air passage portion and the outside of the apparatus to communicate with each other. The air passage holes of the opening/closing portion are formed in the inner cover and are arranged at positions facing the air passage holes of the cover when the opening/closing portion is closed.

When the fan is driven in this printing apparatus with the opening/closing portion closed, outside air is drawn into the air passage portion via the openings of the opening/closing portion. The drawn outside air flows into the apparatus via the air passage holes of the opening/closing portion and the air passage holes of the cover with the air passage portion being used as a duct. The inside of the apparatus is thereby cooled.

SUMMARY

In the printing apparatus described above, opening dimensions of the air passage holes in the cover need to be limited to prevent foreign objects and the fingers of users from entering the air passage holes. Specifically, the width (length of short sides) of each air passage hole which is an elongated hole needs to be limited to a specified width or less.

Accordingly, resistance to an air flow passing the air passage holes of the cover increases and wind noise is generated as unwanted noise. Moreover, if the opening dimensions of the air passage holes in the cover are thus limited, the number of revolutions of the fan needs to be increased to achieve a flow rate of air necessary for cooling the inside of the apparatus. This leads to an increase in operation noise of the fan generated as unwanted noise.

The disclosure is directed to a printing apparatus which can reduce unwanted noise.

A printing apparatus in accordance with some embodiments includes: a case having a door; a duct installed on an inner side of the door in the case and communicating with an outside of the case; a cover installed in the case and having an opening, the opening allowing an inside of the case and the outside of the case to communicate with each other via the duct of the door being closed; a fan configured to perform at least one of drawing of air into the case or exhausting of air from the case via the opening and the duct with the door being closed; and a shutter configured to open the opening during drive of the fan and close the opening while the door is open.

In the aforementioned configuration, it is possible to reduce unwanted noise.

DETAILED DESCRIPTION

Figure 1:
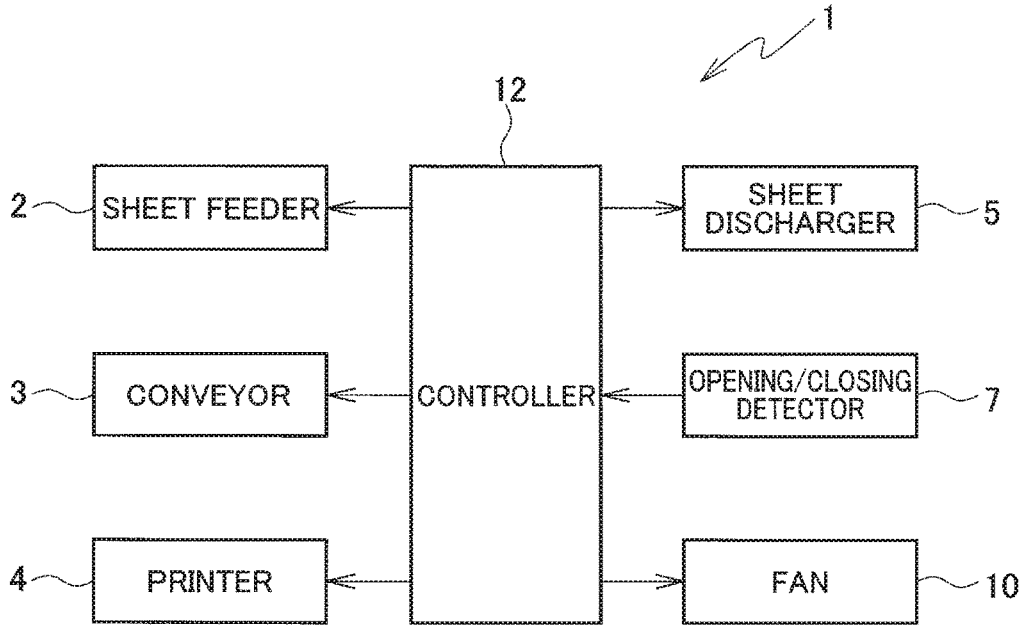
FIG. 1 is a block diagram illustrating a configuration of a printing apparatus according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
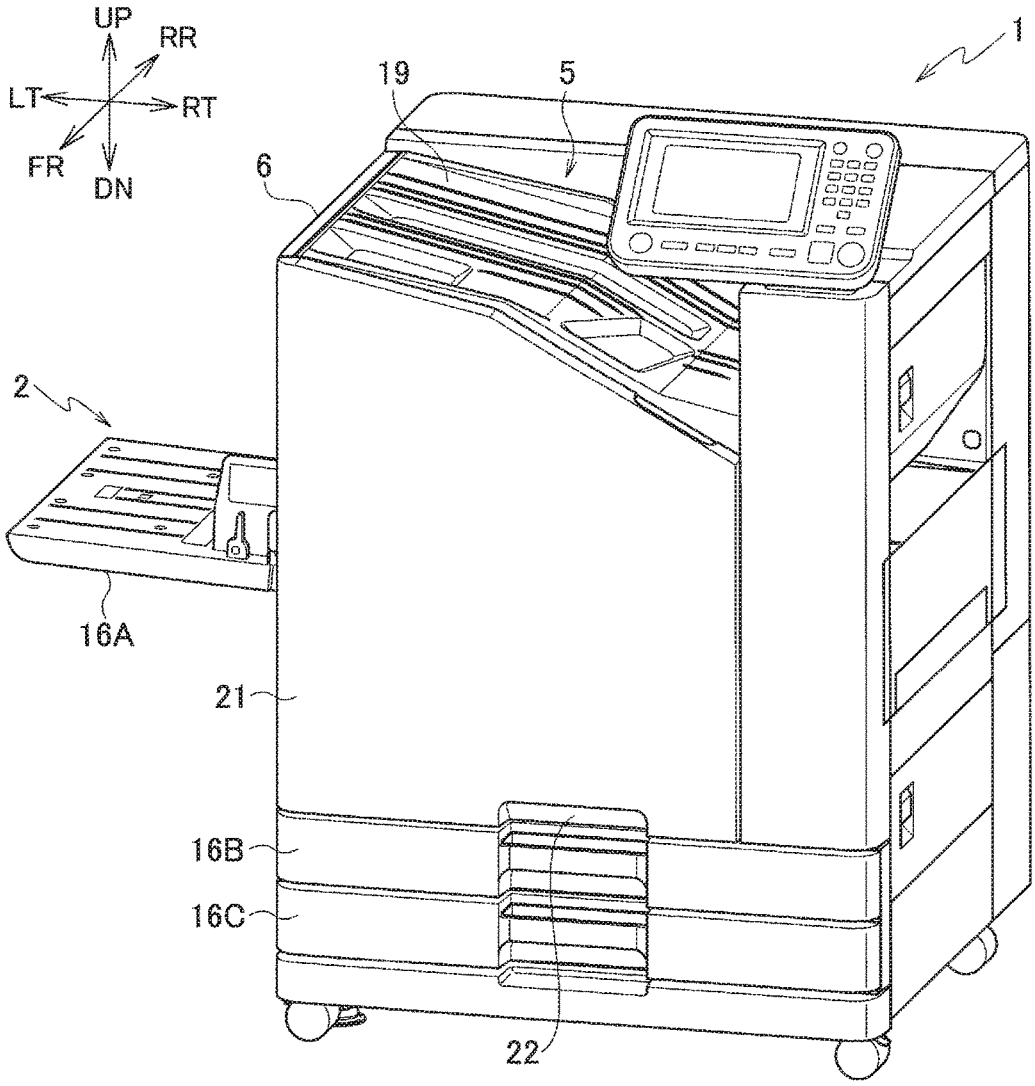
FIG. 2 is an external perspective view of a state where an opening/closing door of the printing apparatus illustrated in FIG. 1 is closed.
Figure 3:
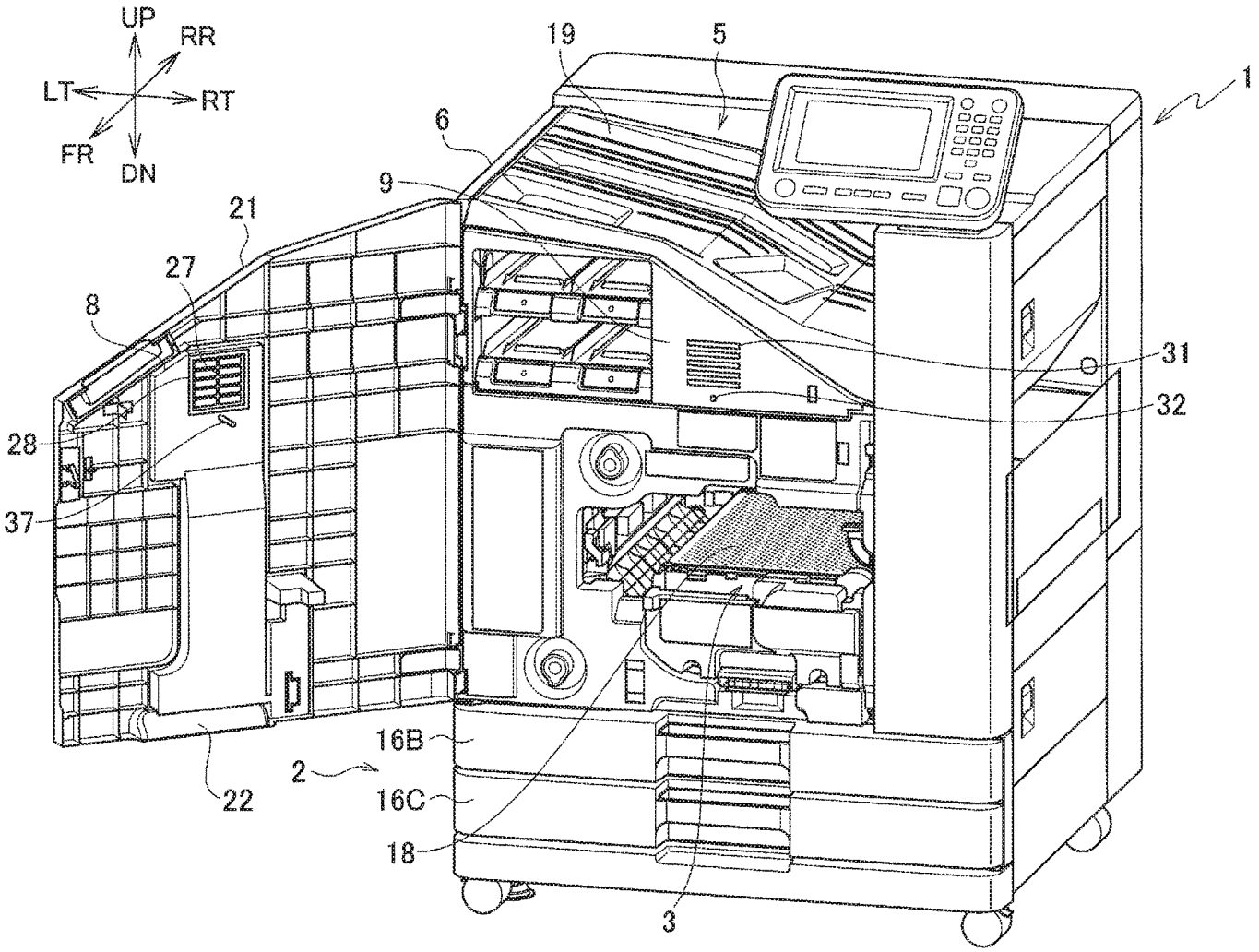
FIG. 3 is an external perspective view of a state where the opening/closing door of the printing apparatus illustrated in FIG. 1 is open.
Figure 4:
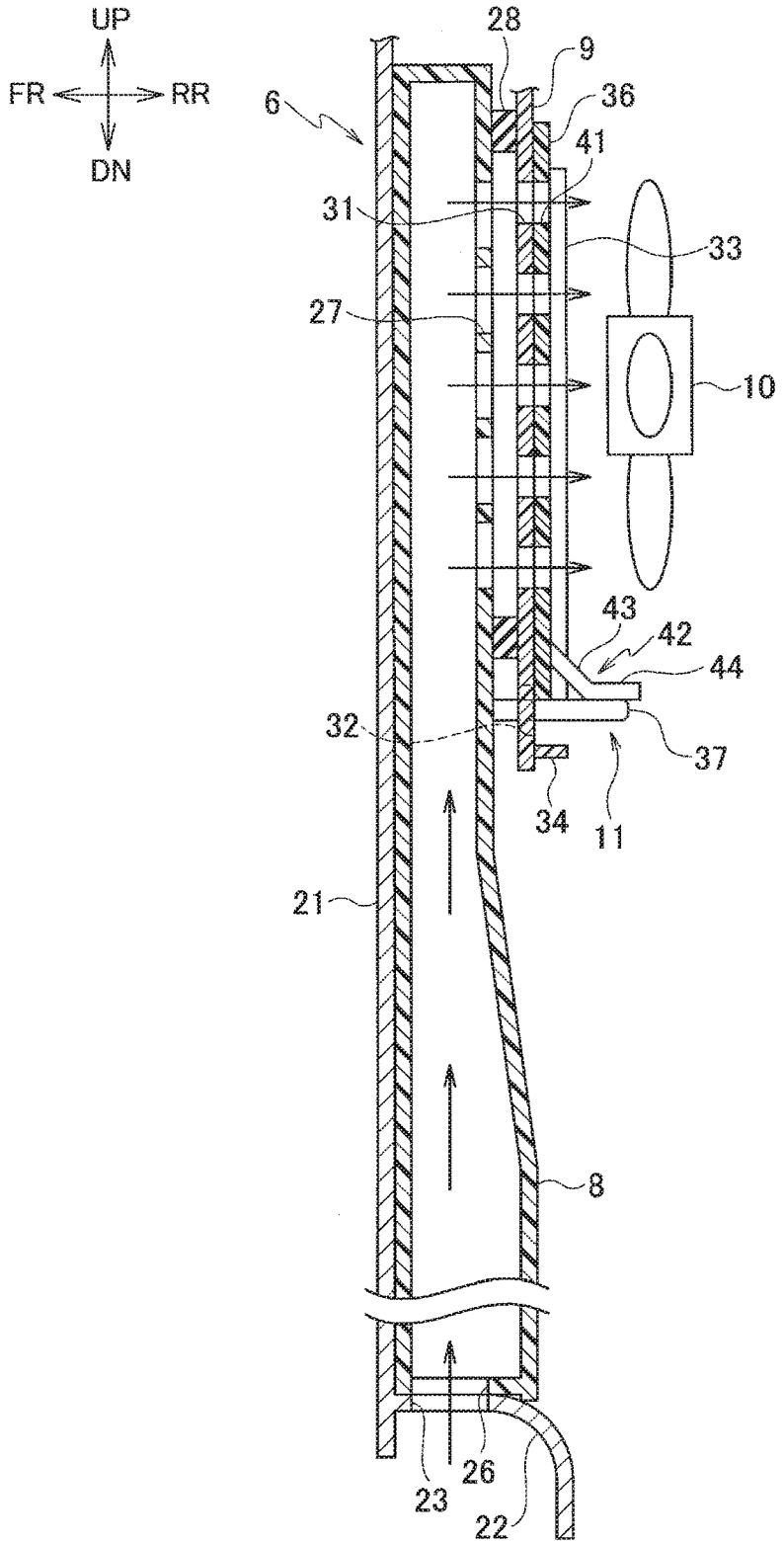
FIG. 4 is an enlarged cross-sectional view of a portion around a shutter in the first embodiment in a state where the opening/closing door is closed.
Figure 5:
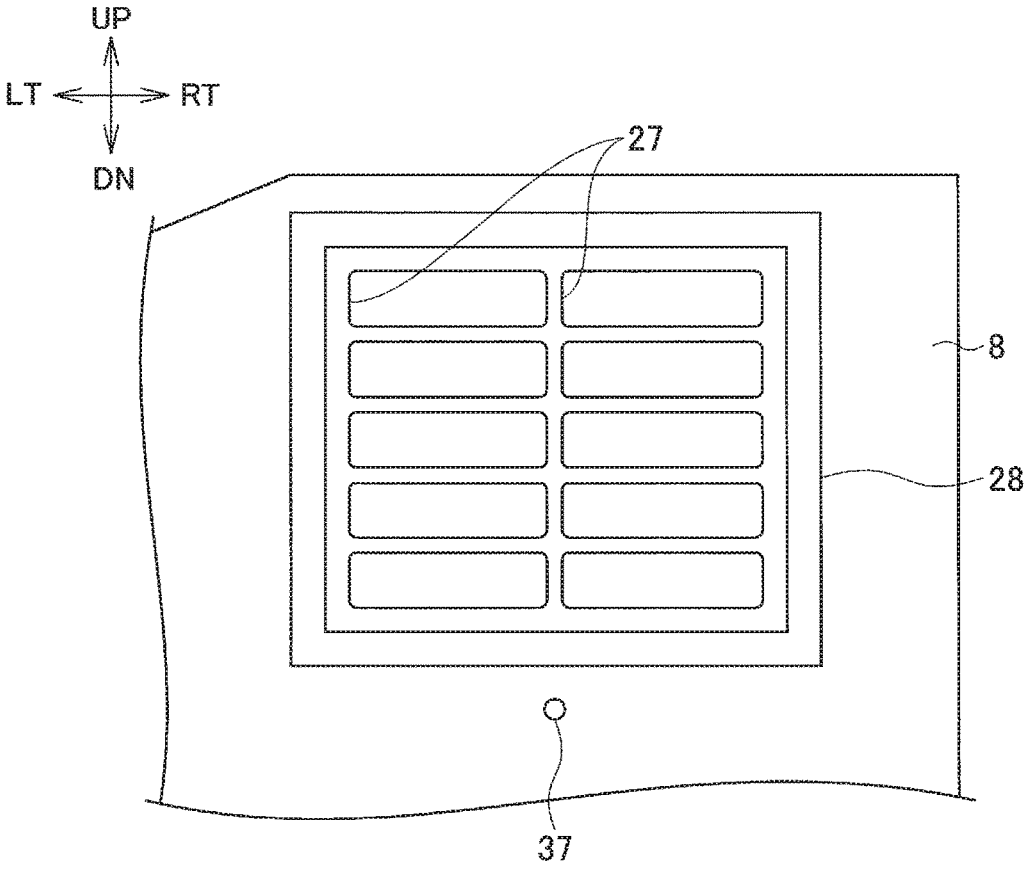
FIG. 5 is an enlarged plan view of a main portion of a duct in the printing apparatus of the first embodiment.
Figure 6:
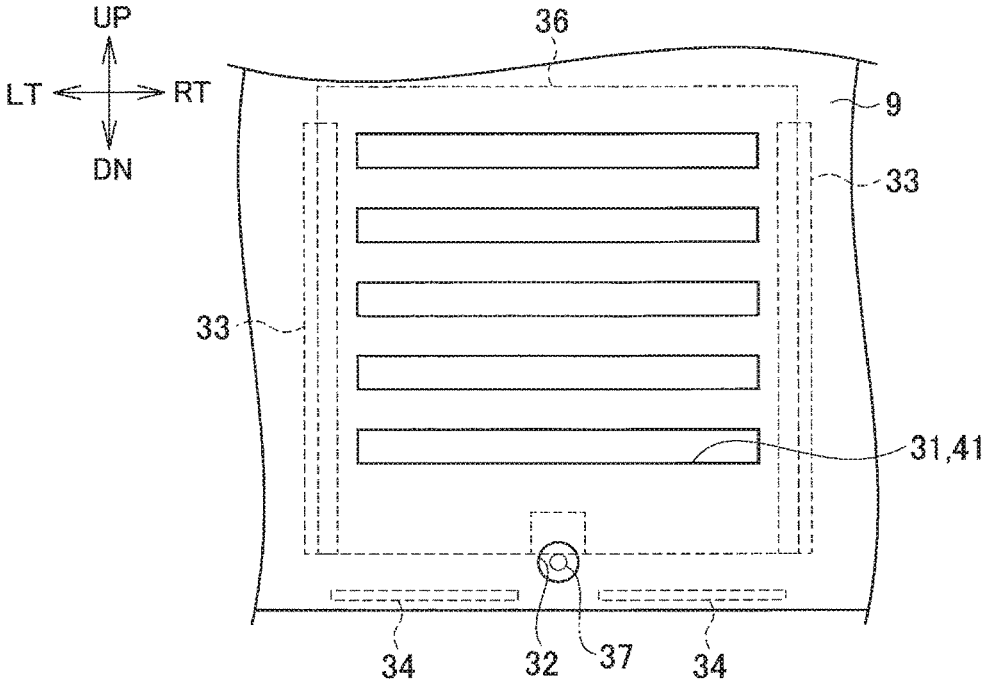
FIG. 6 is an enlarged plan view of a portion around interior cover openings in the first embodiment in the state where the shutter is open.
Figure 7:
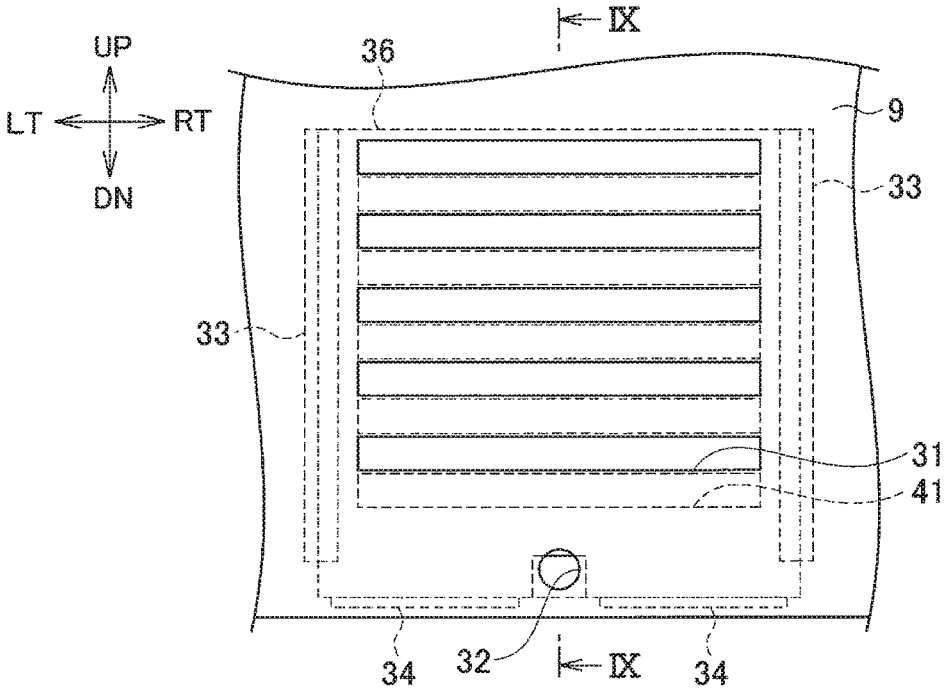
FIG. 7 is an enlarged plan view of the portion around the interior cover openings in the first embodiment in the state where the shutter is closed.
Figure 8:
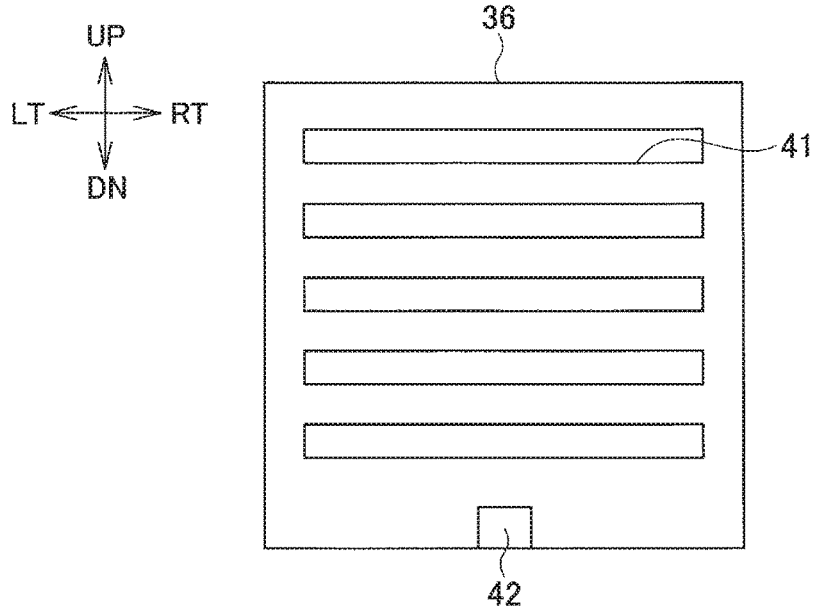
FIG. 8 is a plan view of the shutter in the first embodiment.
Figure 9:
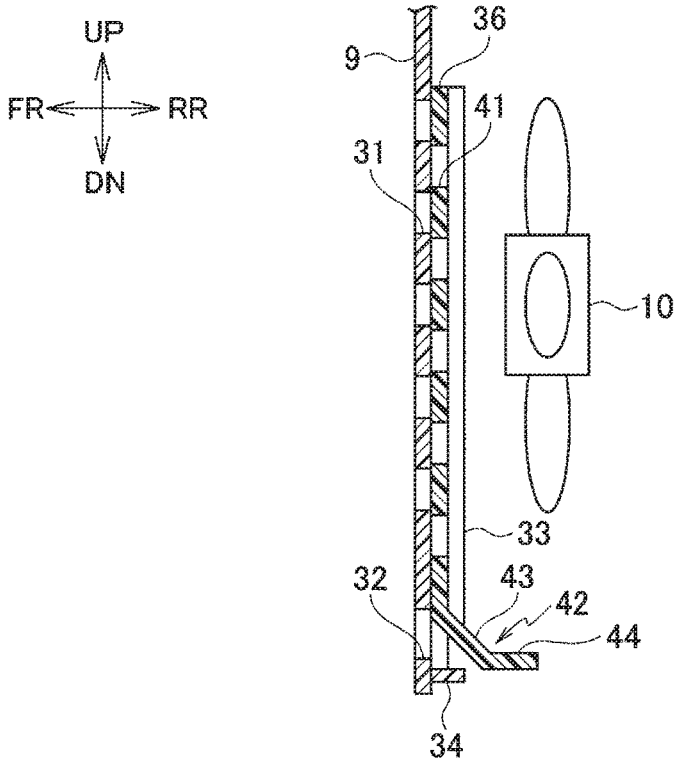
FIG. 9 is a cross-sectional view along the IX-IX line in FIG. 7.

FIG. 1 is a block diagram illustrating a configuration of a printing apparatus according to a first embodiment of the present invention. FIG. 2 is an external perspective view of a state where an opening/closing door of the printing apparatus illustrated in FIG. 1 is closed. FIG. 3 is an external perspective view of a state where the opening/closing door of the printing apparatus illustrated in FIG. 1 is open. FIG. 4 is an enlarged cross-sectional view of a portion around a shutter of the printing apparatus in the first embodiment in a state where the opening/closing door is closed. FIG. 5 is an enlarged plan view of a main portion of a duct in the printing apparatus in the first embodiment. FIG. 6 is an enlarged plan view of a portion around interior cover openings of the printing apparatus in the first embodiment in the state where the shutter is open. FIG. 7 is an enlarged plan view of the portion around the interior cover openings in the state where the shutter is closed. FIG. 8 is a plan view of the shutter in the first embodiment. FIG. 9 is a cross-sectional view along the IX-IX line in FIG. 7. Note that, in FIGS. 2 to 23, the right, left, up, down, front, and rear directions are denoted by RT, LT, UP, DN, FR, and RR, respectively.

As illustrated in FIGS. 1 to 4, the printing apparatus 1 according to the first embodiment includes a sheet feeder 2, a conveyor 3, a printer 4, a sheet discharger 5, a case 6, an opening/closing detector 7, a duct 8, an interior cover (cover) 9, a fan 10, a shutter mechanism 11, and a controller 12.

The sheet feeder 2 feeds sheets which are print media to the conveyor 3. The sheet feeder 2 includes sheet feeding trays 16A to 16C on which the sheets are stacked and multiple sheet feeding rollers (not illustrated) which pick up the sheets from the sheet feeding trays 16A to 16C to convey the sheets to the conveyor 3.

The conveyor 3 conveys the sheets fed by the sheet feeder 2. The conveyor 3 includes a belt platen 18 which conveys the sheets by sucking and holding the sheets on a belt and multiple conveyance rollers (not illustrated) which convey and circulate the sheets for duplex printing.

The printer 4 includes an inkjet head (not illustrated) and prints images on the sheets conveyed by the belt platen 18 of the conveyor 3 by ejecting ink from the inkjet head to the sheets.

The sheet discharger 5 discharges the sheets subjected to printing by the printer 4. The sheet discharger 5 includes a sheet discharge tray 19 on which the sheets subjected to printing are stacked and multiple discharge rollers (not illustrated) which convey the sheets from the belt platen 18 to the sheet discharge tray 19 to discharge the sheets.

The case 6 houses or holds the units of the printing apparatus 1. The case 6 has an opening/closing door 21 which opens and closes a front face of the case 6.

A recess 22 is formed in a lower end portion of the opening/closing door 21. A user inserts the hand into the recess 22 in the case of pulling out the sheet feeding tray 16B. As illustrated in FIG. 4, a door-side opening 23 which communicates with a lower-end opening 26 of the duct 8 to be described later is formed in the recess 22.

The opening/closing detector 7 detects open and closed states of the opening/closing door 21 of the case 6. The opening/closing detector 7 is, for example, an interlock switch.

The duct 8 forms an air flow passage used when the fan 10 draws in air. The duct 8 is provided in the opening/closing door 21, inside the case 6.

The duct 8 is formed of a hollow box-shaped body. As illustrated in FIG. 4, the lower-end opening 26 is formed in a lower end portion of the duct 8. The lower end opening 26 communicates with the door-side opening 23 of the opening/closing door 21. An inner space of the duct 8 thereby communicates with the outside of the case 6 via the lower-end opening 26 and the door-side opening 23.

As illustrated in FIGS. 4 and 5, multiple front-face openings 27 are formed in a front-face portion of the duct 8. The front-face openings 27 are formed at such positions that the front-face openings 27 face interior cover openings 31 to be described later in the state where the opening/closing door 21 is closed. The front-face openings 27 are air passage holes for air flowing from the duct 8 to the interior cover openings 31 during the drive of the fan 10. Note that the left-right direction illustrated by the arrows in FIG. 5 indicates a left-right direction in the case where the duct 8 is viewed from the front side with the opening/closing door 21 opened.

A sealing member 28 is provided in the front-face portion of the duct 8. The sealing member 28 is formed to surround all front-face openings 27. The sealing member 28 is a member which forms a seal around the whole of the front-face openings 27 and the interior cover openings 31 by coming into contact with the interior cover 9 in the state where the opening/closing door 21 is closed.

The interior cover 9 is installed in the case 6 and is a plate-shaped member which partially covers an inside of the printing apparatus 1. As illustrated in FIGS. 3, 4, 6, and 7, the interior cover openings (openings) 31 are formed in the interior cover 9. In the embodiment, five interior cover openings 31 are formed to be arranged in parallel one above another.

The interior cover openings 31 face the front-face openings 27 of the duct 8 in the state where the opening/closing door 21 is closed, and communicate with the outside of the printing apparatus 1 via the front-face openings 27, the inner space of the duct 8, the lower-end opening 26, and the door-side opening 23. In other words, the interior cover openings 31 allow the inside of the case 6 and the outside of the printing apparatus 1 to communicate with each other via the duct 8 in the state where the opening/closing door 21 is closed.

The interior cover openings 31 are each formed in a shape elongated in the left-right direction in a plan view. The width (length in the direction of short sides (up-down direction)) of each interior cover opening 31 is set to such a width that wind noise caused by the interior cover opening 31 during the drive of the fan 10 can be suppressed and the flow rate of air for cooling the inside of the printing apparatus 1 can be achieved with the number of revolutions of the fan 10 being suppressed. For example, the width of each interior cover opening 31 is set to about 5 mm.

A pushing rod opening 32 is formed in the interior cover 9. The pushing rod opening 32 is a through hole in which a pushing rod 37 to be described later is inserted. The pushing rod opening 32 is formed below the lowermost interior cover opening 31.

Two guide members 33 and two stoppers 34 are provided on a back face (rear face) of the interior cover 9.

The guide members 33 are members by which a shutter 36 to be described later is guided to move vertically along the back face of the interior cover 9. The two guide members 33 are arranged away from each other in the left-right direction with the interior cover openings 31 provided therebetween.

The stoppers 34 support the shutter 36 in a closed state. The stoppers 34 are arranged at predetermined positions below the lowermost interior cover opening 31.

The fan 10 draws in air to cool the inside of the case 6 (printing apparatus 1). Specifically, upon cooling the inside of the case 6, the fan 10 draws air into the case 6 via the interior cover openings 31 and the duct 8 with the opening/closing door 21 closed. The fan 10 is arranged near the interior cover openings 31, on the back side (rear side) of the interior cover 9.

The shutter mechanism 11 is a mechanism for opening and closing the interior cover openings 31. The shutter mechanism 11 includes the shutter 36 and the pushing rod 37.

The shutter 36 opens and closes the interior cover openings 31 to open the interior cover openings 31 during the drive of the fan 10 and close the interior cover openings 31 while the opening/closing door 21 is open. As illustrated in FIGS. 8 and 9, the shutter 36 is formed of a plate-shaped member having shutter openings 41. The shutter openings 41 are openings through which the interior cover openings 31 can be made open. The shutter openings 41 are formed in the same shape as the interior cover openings 31 in the plan view. In the embodiment, the same number of shutter openings 41 as the interior cover openings 31, that is five shutter openings 41 are formed. The five shutter openings 41 are formed to be arranged in parallel one above another at the same intervals as the interior cover openings 31. An interval between each two adjacent shutter openings 41 is set to be equal to or greater than the width of each interior cover opening 31.

An operated portion 42 is formed in a lower end portion of the shutter 36. The operated portion 42 is a portion which receives operations of opening and closing the shutter 36 performed with the pushing rod 37. The operated portion 42 includes a tilted portion 43 and a supported portion 44.

The tilted portion 43 is a portion which is pushed by the pushing rod 37 when the opening/closing door 21 is closed. The tilted portion 43 is tilted downward toward the rear side.

The supported portion 44 is a portion where the pushing rod 37 supports the shutter 36 in the open state. The supported portion 44 is a horizontal portion formed to be continuous with the tilted portion 43.

The open state of the shutter 36 is a state where the interior cover openings 31 are open with the shutter openings 41 respectively meeting the corresponding interior cover openings 31 as illustrated in FIGS. 4 and 6. The closed state of the shutter 36 is a state where the shutter openings 41 and the interior cover openings 31 are at positions shifted from one another and the shutter 36 closes the interior cover openings 31 as illustrated in FIGS. 7 and 9.

The pushing rod 37 is a member which pushes the shutter 36 upward to open the shutter 36. As illustrated in FIGS. 3 to 5, the pushing rod 37 is a rod-shaped member extending from a front-face portion of the duct 8. When the opening/closing door 21 is closed, the pushing rod 37 pushes the shutter 36 upward by pushing the tilted portion 43 of the shutter 36. Moreover, the pushing rod 37 maintains the open state of the shutter 36 by supporting the supported portion 44 of the shutter 36 in the open state of the shutter 36.

The controller 12 controls operation of the entire printing apparatus 1. The controller 12 includes a CPU, a RAM, a ROM, a hard disk drive, and the like.

Next, operations of opening and closing the shutter 36 in the printing apparatus 1 are described.

In the state where the opening/closing door 21 is closed, as illustrated in FIGS. 4 and 6, the shutter 36 is open. Specifically, the pushing rod 37 is inserted in the pushing rod opening 32 and supports the supported portion 44 of the shutter 36.

When the opening/closing door 21 is opened, the pushing rod 37 is pulled out from the pushing rod opening 32 with turning of the opening/closing door 21. In this case, the shutter 36 moves downward while the tilted portion 43 slides on the front end of the pushing rod 37 gradually moving forward. In a state where the pushing rod 37 is pulled out from the pushing rod opening 32, the shutter 36 is supported on the stoppers 34 and is closed.

When the opening/closing door 21 in the open state is closed, the pushing rod 37 is inserted into the pushing rod opening 32 with the turning of the opening/closing door 21. In this case, the front end of the pushing rod 37 gradually moving rearward pushes the tilted portion 43 of the shutter 36 to lift the shutter 36. In the state where the opening/closing door 21 is closed, the supported portion 44 of the shutter 36 is supported on the pushing rod 37 and the shutter 36 is open.

As described above, in the printing apparatus 1, the operations of opening and closing the shutter 36 are performed in conjunction with the opening and closing of the opening/closing door 21.

Next, an operation of cooling the inside of the printing apparatus 1 is described.

The cooling of the inside of the printing apparatus 1 is performed in the state where the opening/closing door 21 is closed. For example, the cooling is performed during a printing operation in the printing apparatus 1.

In the state where the opening/closing door 21 is closed, as illustrated in FIG. 4, the front-face openings 27 of the duct 8 and the interior cover openings 31 are located close to and face one another and the sealing member 28 forms a seal around the whole of the front-face openings 27 and the interior cover openings 31. Moreover, the shutter 36 is open.

When the inside of the printing apparatus 1 is to be cooled, the controller 12 drives the fan 10 such that air is drawn into the case 6.

In this case, since the shutter 36 is open, the drive of the fan 10 causes outside air to flow into the case 6 along a route illustrated by the arrows in FIG. 4.

Specifically, the drive of the fan 10 causes the outside air to be drawn into the duct 8 from the lower-end opening 26 of the duct 8. The outside air drawn into the duct 8 passes through the duct 8 and then flows to the back side of the interior cover 9 via the front-face openings 27, the interior cover openings 31, and the shutter openings 41. Drawing the outside air into the case 6 as described above cools the inside of the printing apparatus 1.

As described above, the printing apparatus 1 includes the shutter 36 which opens the interior cover openings 31 during the drive of the fan 10 and which closes the interior cover openings 31 while the opening/closing door 21 is opened. This can eliminate limitations on opening dimensions of the interior cover openings 31 which are provided to prevent foreign objects and the fingers of users from entering the interior cover openings 31 when the opening/closing door 21 is opened. Accordingly, the width of the interior cover openings 31 can be set to such a width that wind noise caused by the interior cover openings 31 during the drive of the fan 10 can be suppressed and the flow rate of air for cooling the inside of the printing apparatus 1 can be achieved with the number of revolutions of the fan 10 being suppressed. The printing apparatus 1 can thereby reduce wind noise caused by the interior cover openings 31 and operation noise of the fan 10, and can thus achieve noise reduction.

Moreover, in the printing apparatus 1, since the shutter 36 is closed in conjunction with the opening of the opening/closing door 21, the shutter 36 can be prevent from being set in the open state when the opening/closing door 21 is open with high accuracy. This can reduce the case where foreign objects and the fingers of users enter the interior cover openings 31.

Next, description is given of a second embodiment in which the interior cover and the shutter mechanism in the aforementioned first embodiment are changed.

Figure 10:
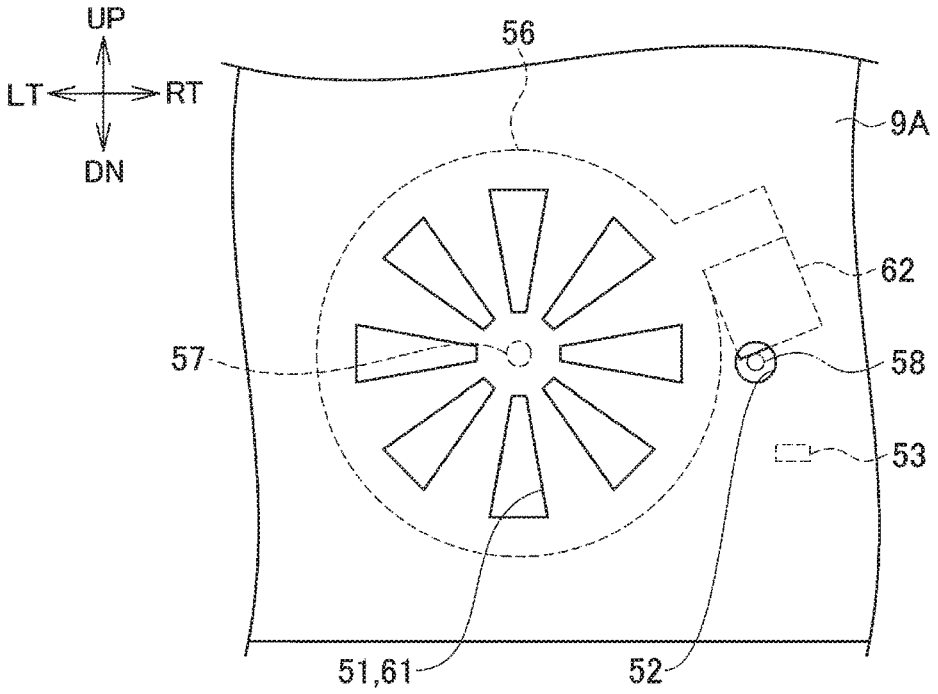
FIG. 10 is an enlarged plan view of a portion around interior cover openings in a second embodiment in the state where a shutter is open.
Figure 11:
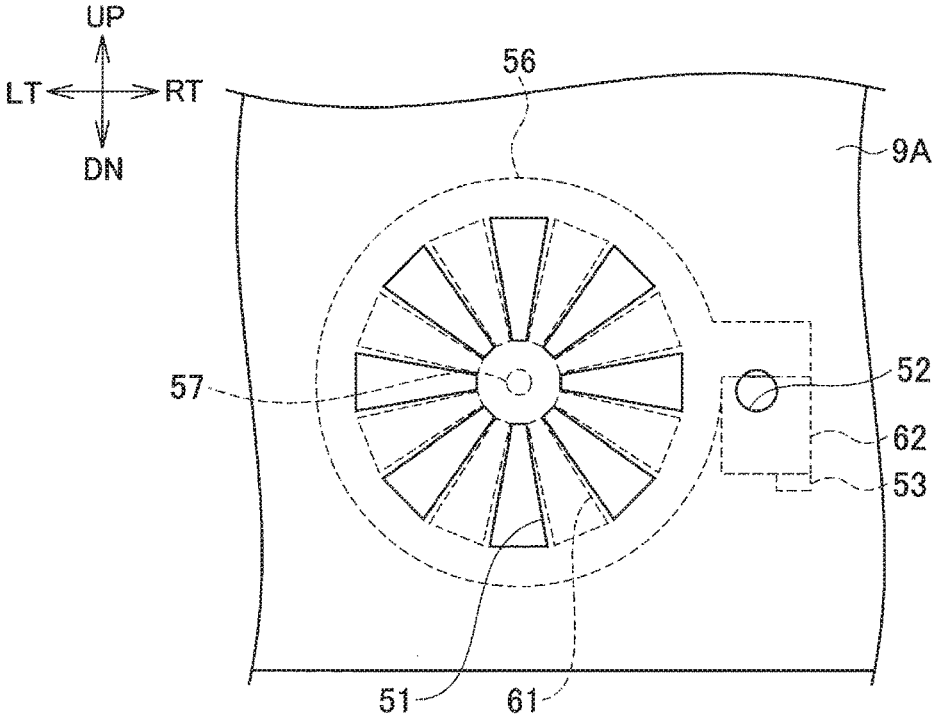
FIG. 11 is an enlarged plan view of the portion around the interior cover openings in the second embodiment in the state where the shutter is closed.
Figure 12:
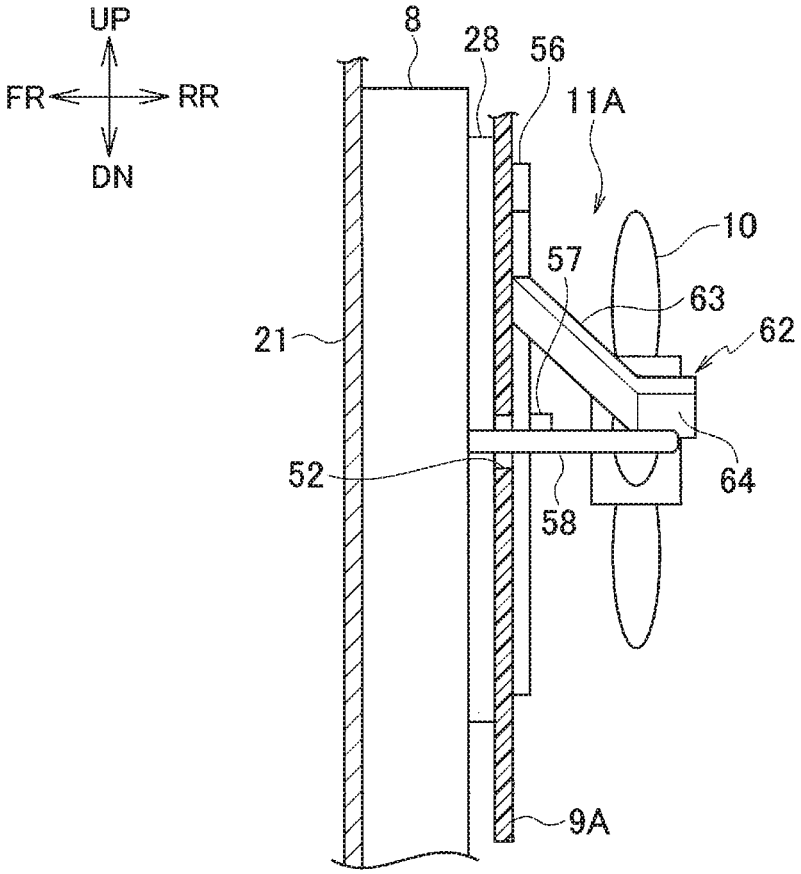
FIG. 12 is a schematic configuration view of a shutter mechanism in the second embodiment in the state where the shutter is open.
Figure 13:
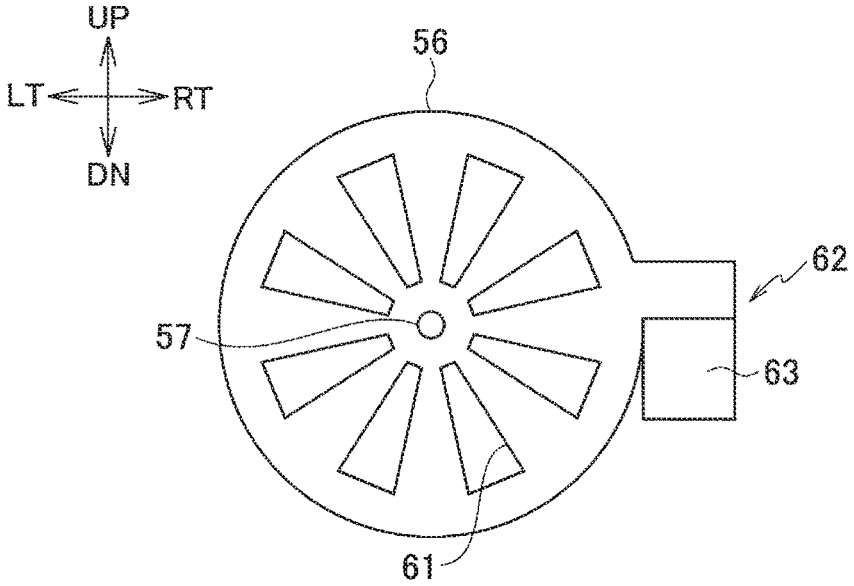
FIG. 13 is a plan view of the shutter in the second embodiment.
Figure 14:
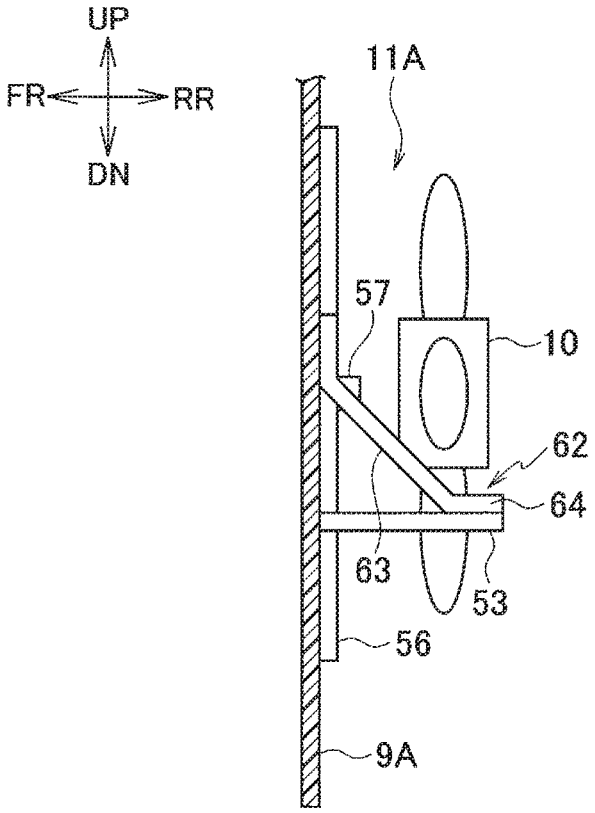
FIG. 14 is a schematic configuration view of the shutter mechanism in the second embodiment in the state where the shutter is closed.

FIG. 10 is an enlarged plan view of a portion around interior cover openings in the second embodiment in the case where a shutter is open. FIG. 11 is an enlarged plan view of the portion around the interior cover openings in the second embodiment in the state where the shutter is closed. FIG. 12 is a schematic configuration view of the shutter mechanism in the second embodiment in the state where the shutter is open. FIG. 13 is a plan view of the shutter in the second embodiment. FIG. 14 is a schematic configuration view of the shutter mechanism in the second embodiment in the state where the shutter is closed. Here, FIG. 12 is a view in the state where the opening/closing door 21 is closed and FIG. 14 is a view in the state where the opening/closing door 21 is open.

As illustrated in FIGS. 10 and 11, an interior cover 9A in the second embodiment is a cover in which the interior cover openings 31 and the pushing rod opening 32 in the interior cover 9 of the first embodiment are replaced by interior cover openings 51 and a pushing rod opening 52, respectively. Moreover, the guide members 33 and the stoppers 34 in the first embodiment are omitted and a stopper 53 is provided on a back face (rear face) of the interior cover 9A in the second embodiment.

The interior cover openings 51 are each formed in a trapezoidal shape in the plan view. In the interior cover 9A, multiple interior cover openings 51 are arranged in a circular pattern about a shutter holding shaft 57 to be described later. In the embodiment, eight interior cover openings 51 are arranged in a circular pattern.

The interior cover openings 51 are formed to have such dimensions that wind noise caused by the interior cover openings 51 during the drive of the fan 10 can be suppressed and the flow rate of air for cooling the inside of the printing apparatus 1 can be achieved with the number of revolutions of the fan 10 being suppressed.

The pushing rod opening 52 is a through hole in which a pushing rod 58 to be described later is inserted. The pushing rod opening 52 is formed on a lateral side (right side) of a region in which the interior cover openings 51 are arranged.

The stopper 53 is a member which supports a supported portion 64 to be described later when a shutter 56 is closed. The stopper 53 is arranged at a predetermined position below the pushing rod opening 52.

As illustrated in FIG. 12, the shutter mechanism 11A in the second embodiment includes the shutter 56, the shutter holding shaft 57, and the pushing rod 58.

The shutter 56 opens and closes the interior cover openings 51. As illustrated in FIGS. 13 and 14, the shutter 56 is formed of a plate-shaped member having shutter openings 61.

The shutter openings 61 are openings through which the interior cover openings 51 can be made open. The shutter openings 61 are formed in the same shape as the interior cover openings 51 in the plan view. In the embodiment, the same number of shutter openings 61 as the interior cover openings 51, that is eight shutter openings 61 are formed. The eight shutter openings 61 are arranged in a circular pattern which is the same pattern as the interior cover openings 51. The shutter openings 61 are arranged such that a portion between each two adjacent shutter openings 61 can close a corresponding one of the interior cover openings 51.

An operated portion 62 is formed in one side portion (right side portion) of the shutter 56. The operated portion 62 is a portion which receives operations of opening and closing the shutter 56 performed with the pushing rod 58. The operated portion 62 includes a tilted portion 63 and the supported portion 64.

The tilted portion 63 is a portion which is pushed by the pushing rod 58 when the opening/closing door 21 is closed. The tilted portion 63 is tilted downward toward the rear side.

The supported portion 64 is a portion where the pushing rod 58 supports the shutter 56 in the open state. Moreover, the supported portion 64 is a portion where the stopper 53 supports the shutter 56 in the closed state. The supported portion 64 is formed to be continuous with the tilted portion 63 and is formed to be horizontal when the shutter 56 is closed.

The open state of the shutter 56 is a state where the interior cover openings 51 are open with the shutter openings 61 respectively meeting the corresponding interior cover openings 51 as illustrated in FIG. 10. The closed state of the shutter 56 is a state where the shutter openings 61 and the interior cover openings 51 are at positions shifted from one another and the shutter 56 closes the interior cover openings 51 as illustrated in FIG. 11.

The shutter holding shaft 57 holds the shutter 56 on the back face (rear face) of the interior cover 9A such that the shutter 56 is turnable.

The pushing rod 58 is a member which turns the shutter 56 to open the shutter 56. As illustrated in FIG. 12, the pushing rod 58 is a rod-shaped member extending from a front face portion of the duct 8. When the opening/closing door 21 is closed, the pushing rod 58 turns the shutter 56 by pushing the tilted portion 63 of the shutter 56. Moreover, as illustrated in FIG. 12, the pushing rod 58 maintains the open state of the shutter 56 by supporting the supported portion 64 of the shutter 56 in the open state of the shutter 56.

Next, operations of opening and closing the shutter 56 in the second embodiment are described.

In the state where the opening/closing door 21 is closed, as illustrated in FIG. 10, the shutter 56 is open. Specifically, as illustrated in FIG. 12, the pushing rod 58 is inserted in the pushing rod opening 52 and supports the supported portion 64 of the shutter 56.

When the opening/closing door 21 is opened, the pushing rod 58 is pulled out from the pushing rod opening 52 with turning of the opening/closing door 21. In this case, the shutter 56 turns clockwise as viewed from the front side while the tilted portion 63 slides on the front end of the pushing rod 58 gradually moving forward. In a state where the pushing rod 58 is pulled out from the pushing rod opening 52, the supported portion 64 of the shutter 56 is supported on the stopper 53 and the shutter 56 is closed.

When the opening/closing door 21 in the open state is closed, the pushing rod 58 is inserted into the pushing rod opening 52 with the turning of the opening/closing door 21. In this case, the front end of the pushing rod 58 gradually moving rearward pushes the tilted portion 63 of the shutter 56 to cause the shutter 56 to turn counterclockwise as viewed from the front side. Then, in the state where the opening/closing door 21 is closed, the supported portion 64 of the shutter 56 is supported on the pushing rod 58 and the shutter 56 is open.

As described above, also in the second embodiment, the operations of opening and closing the shutter 56 are performed in conjunction with the opening and closing of the opening/closing door 21.

Figure 15:
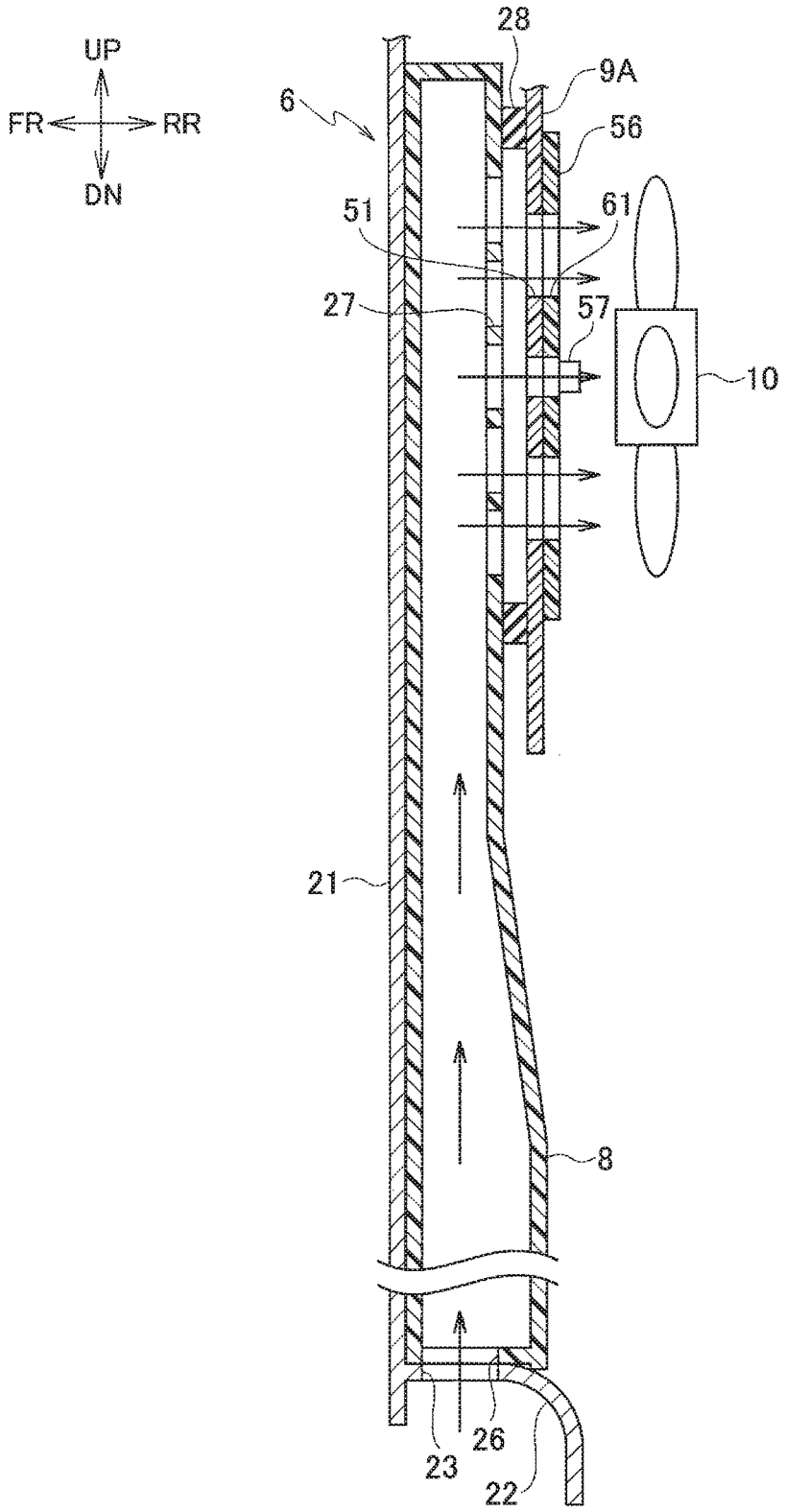
FIG. 15 is a view explaining a flow of air in cooling of an inside of the printing apparatus in the second embodiment.

In cooling of the inside of the printing apparatus 1 in the second embodiment, the drive of the fan 10 causes the outside air to be drawn into the case 6 along a route illustrated by the arrows in FIG. 15.

Specifically, the drive of the fan 10 causes the outside air to be drawn into the duct 8 from the lower-end opening 26 of the duct 8 as in the first embodiment. The outside air drawn into the duct 8 passes through the duct 8 and then flows to the back side of the interior cover 9A via the front-face openings 27, the interior cover openings 51, and the shutter openings 61. Drawing the outside air into the case 6 as described above cools the inside of the printing apparatus 1.

Also in the second embodiment, providing the shutter 56 in the printing apparatus 1 can eliminate limitations on opening dimensions of the interior cover openings 51 as in the first embodiment. Accordingly, also in the second embodiment, it is possible to reduce wind noise caused by the interior cover openings 51 and operation noise of the fan 10 and thereby achieve noise reduction as in the first embodiment.

Moreover, in the second embodiment, since the shutter 56 is closed in conjunction with the opening of the opening/closing door 21 as in the first embodiment, the shutter 56 can be prevented from being set in the open state when the opening/closing door 21 is open with high accuracy. This can reduce the case where foreign objects and the fingers of users enter the interior cover openings 51.

Next, description is given of a third embodiment in which the interior cover and the shutter mechanism in the aforementioned first embodiment are changed.

Figure 16:
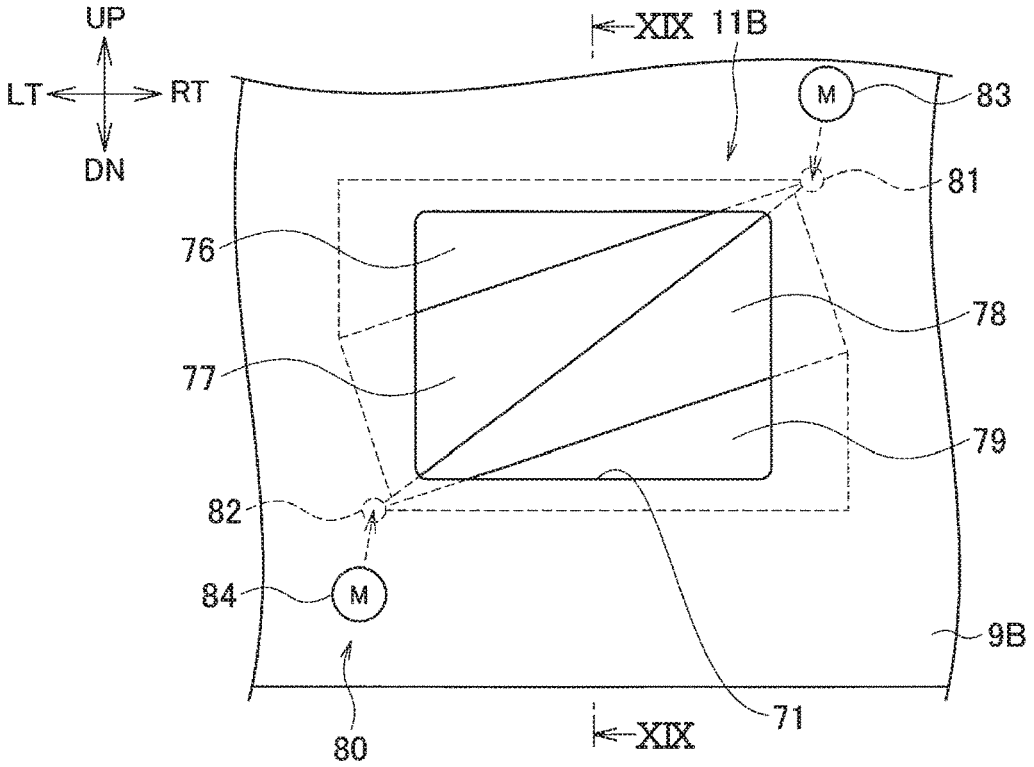
FIG. 16 is an enlarged plan view of a portion around an interior cover opening in a third embodiment as viewed from the front side in the state where a shutter is closed.
Figure 17:
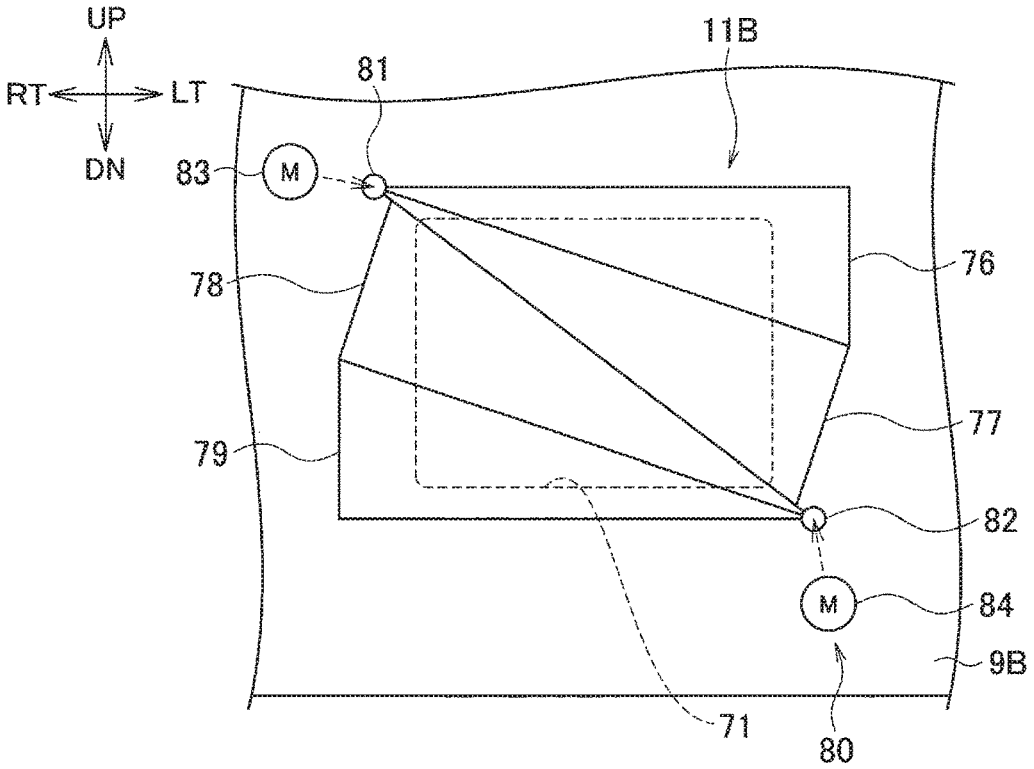
FIG. 17 is an enlarged plan view of the portion around the interior cover opening in the third embodiment as viewed from the rear side in the state where the shutter is closed.
Figure 18:
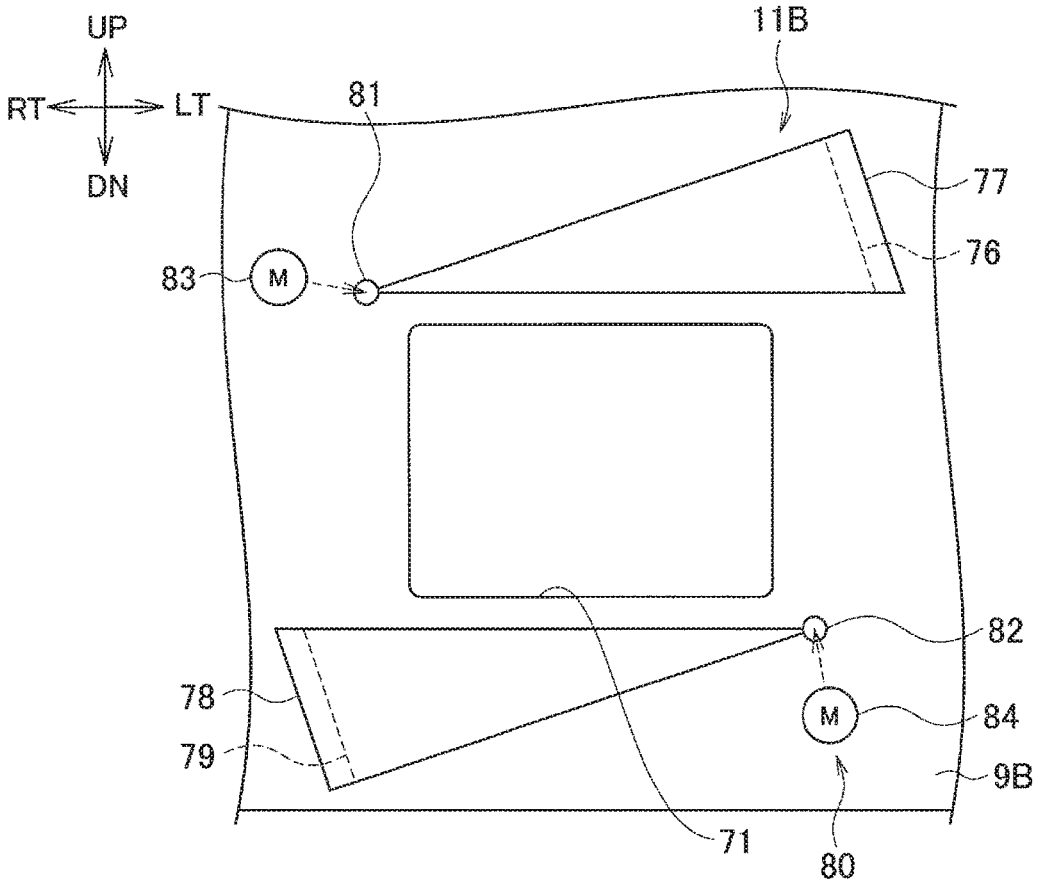
FIG. 18 is an enlarged plan view of the portion around the interior cover opening in the third embodiment as viewed from the rear side in the state where the shutter is open.
Figure 19:
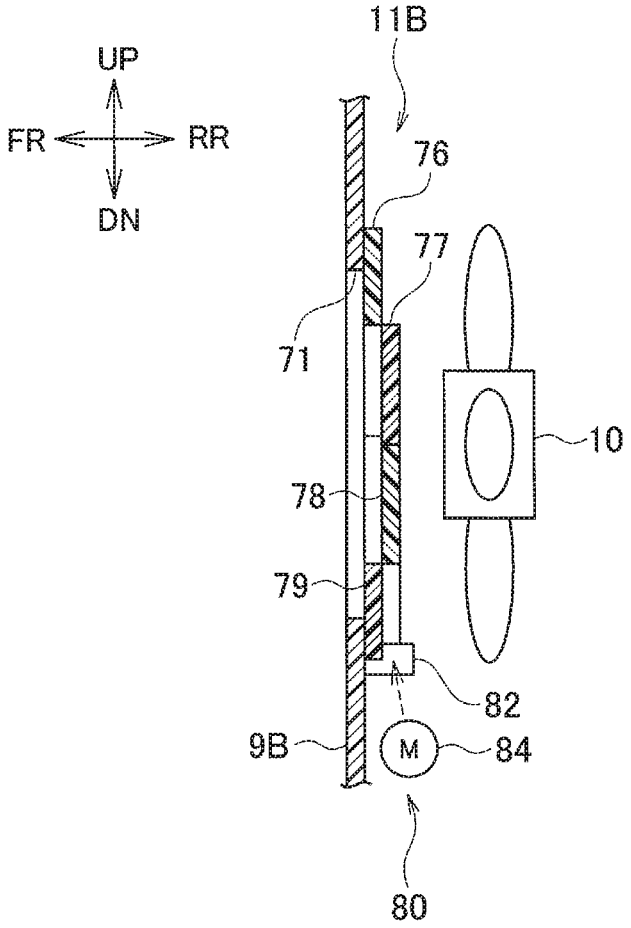
FIG. 19 is a cross-sectional view taken along the XIX-XIX line in FIG. 16.
Figure 20:
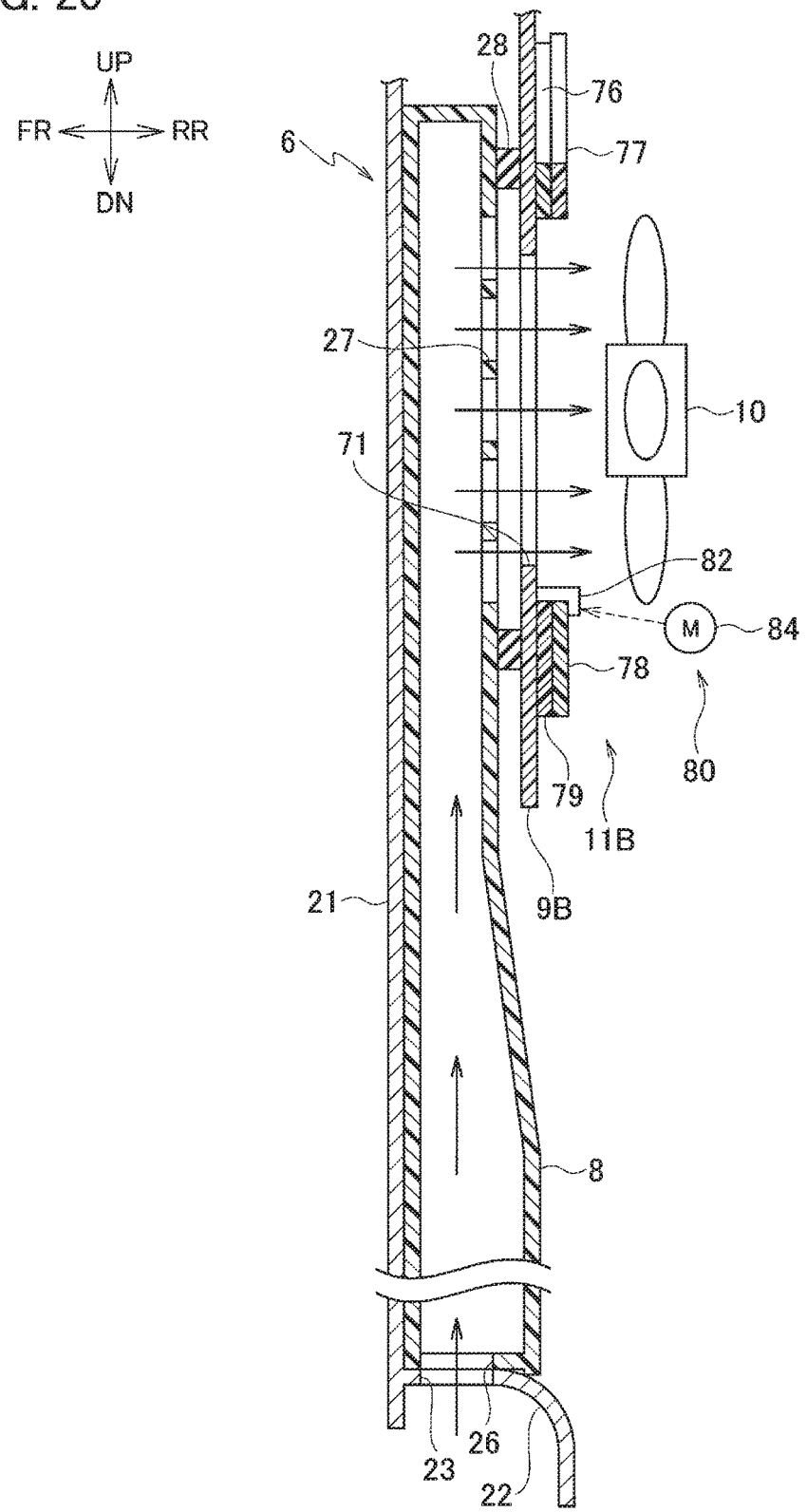
FIG. 20 is a view explaining a flow of air in cooling of the inside of the printing apparatus in the third embodiment.

FIG. 16 is an enlarged plan view of a portion around an interior cover opening in the third embodiment as viewed from the front side (forward side) in the state where a shutter is closed. FIG. 17 is an enlarged plan view of the portion around the interior cover opening in the third embodiment as viewed from the rear side (back side) in the state where the shutter is closed. FIG. 18 is an enlarged plan view of the portion around the interior cover opening in the third embodiment as viewed from the rear side (back face side) in the state where the shutter is open. FIG. 19 is a cross-sectional view taken along the XIX-XIX line in FIG. 16.

As illustrated in FIGS. 16 to 18, an interior cover 9B in the third embodiment is a cover in which the interior cover openings 31 of the interior cover 9 in the aforementioned first embodiment are replaced by an interior cover opening 71 and the pushing rod opening 32, the guide members 33, and stoppers 34 are omitted.

The interior cover opening 71 is formed in a rectangular shape in the plan view. The interior cover opening 71 is formed to have such dimensions that wind noise caused by the interior cover opening 71 during the drive of the fan 10 can be suppressed and the flow rate of air for cooling the inside of the printing apparatus 1 can be achieved with the number of revolutions of the fan 10 being suppressed.

As illustrated in FIGS. 16 to 18, a shutter mechanism 11B in the third embodiment includes shutters 76 to 79 and a shutter driver 80.

The shutters 76 to 79 are plate-shaped members which open and close the interior cover opening 71. The interior cover opening 71 is opened and closed by turning the shutters 76, 77 about a shutter opening/closing shaft 81 to be described later and by turning the shutters 78, 79 about a shutter opening/closing shaft 82 to be described later. The shutters 76 to 79 are arranged on the back face side (rear face side) of the interior cover 9B.

In the open state of the shutters 76 to 79, as illustrated in FIG. 18, the shutters 76, 77 are retreated to a position above the interior cover opening 71 to be stacked one on top of the other while the shutters 78, 79 are retreated to a position below the interior cover opening 71 to be stacked one on top of the other, and the interior cover opening 71 is open. In the closed state of the shutters 76 to 79, as illustrated in FIGS. 16 and 17, the shutters 76 to 79 are spread on the interior cover opening 71 and close the interior cover opening 71.

The shutter driver 80 performs drive of opening and closing the shutters 76 to 79. The shutter driver 80 includes the shutter opening/closing shafts 81, 82 and shutter opening/closing motors 83, 84.

The shutter opening/closing shaft 81 supports the shutters 76, 77 such that the shutters 76, 77 are turnable, and the shutter opening/closing shaft 82 supports the shutters 78, 79 such that the shutters 78, 79 are turnable. The shutter opening/closing shafts 81, 82 are arranged respectively on opposite sides of the interior cover opening 71 in a direction of one diagonal of the interior cover opening 71.

The shutter opening/closing motor 83 turns the shutters 76, 77 about the shutter opening/closing shaft 81. The shutter opening/closing motor 84 turns the shutters 78, 79 about the shutter opening/closing shaft 82.

In the third embodiment, the shutters 76 to 79 are open in the state where the opening/closing door 21 is closed. In cooling of the inside of the printing apparatus 1, the drive of the fan 10 causes the outside air to flow into the case 6 along a route illustrated by the arrows in FIG. 20.

Specifically, the drive of the fan 10 causes the outside air to be drawn into the duct 8 from the lower-end opening 26 of the duct 8 as in the first embodiment. The outside air drawn into the duct 8 passes through the duct 8 and then flows to the back side of the interior cover 9B via the front-face openings 27 and the interior cover opening 71. Drawing the outside air into the case 6 as described above cools the inside of the printing apparatus 1.

When the opening/closing door 21 is opened, the controller 12 sets the shutters 76 to 79 to the closed state. Specifically, when the opening/closing detector 7 detects that the opening/closing door 21 is opened, the controller 12 controls the shutter driver 80 to spread the shutters 76 to 79 on the interior cover opening 71 as illustrated in FIGS. 16 and 17. The controller 12 maintains the closed state of the shutter 76 to 79 while the opening/closing door 21 is open. When the opening/closing detector 7 detects that the opening/closing door 21 is closed, the controller 12 controls the shutter driver 80 to set the shutters 76 to 79 to the open state.

Also in the third embodiment, providing the shutters 76 to 79 in the printing apparatus 1 can eliminate limitations on opening dimensions of the interior cover opening 71 as in the first embodiment. Accordingly, also in the third embodiment, it is possible to reduce wind noise caused by the interior cover opening 71 and operation noise of the fan 10 and thereby achieve noise reduction as in the first embodiment.

Note that, even when the opening/closing door 21 is closed, the shutters 76 to 79 may be closed while the operation of cooling the inside of the printing apparatus 1 is not performed.

Next, description is given of a fourth embodiment in which the interior cover and the shutter mechanism in the aforementioned first embodiment are changed.

Figure 21:
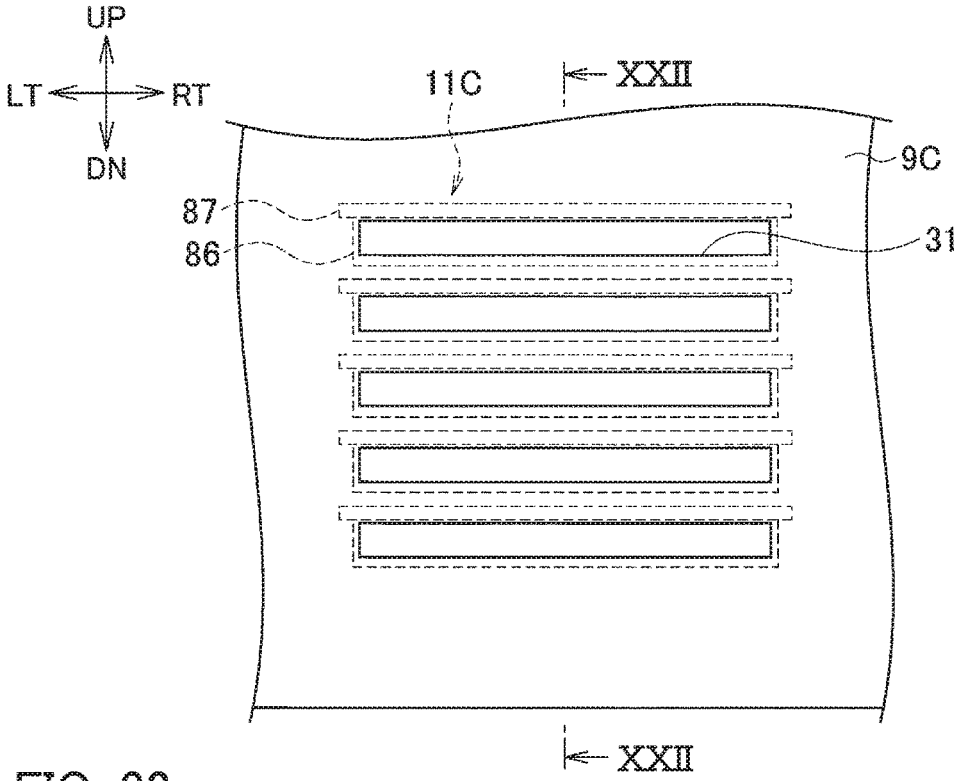
FIG. 21 is an enlarged plan view of a portion around interior cover openings in a fourth embodiment.
Figure 22:
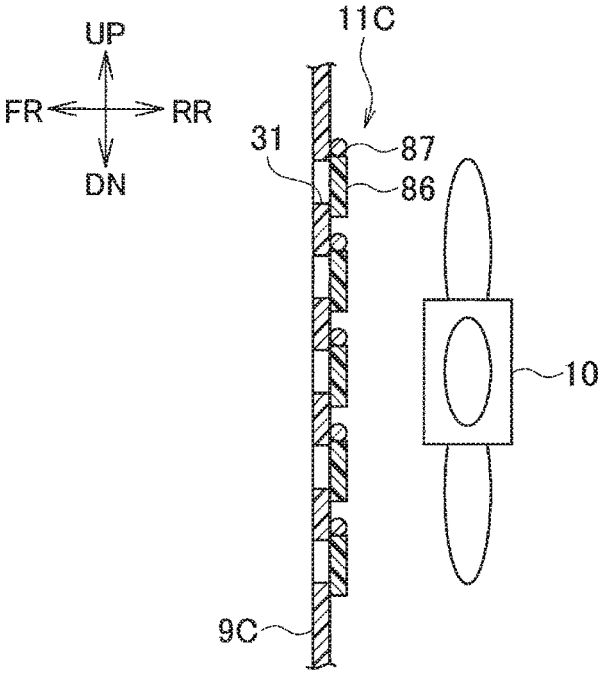
FIG. 22 is a cross-sectional view taken along the line XXII-XXII in FIG. 21.

FIG. 21 is an enlarged plan view of a portion around interior cover openings in the fourth embodiment. FIG. 22 is a cross-sectional view taken along the line XXII-XXII in FIG. 21.

As illustrated in FIGS. 21 and 22, an interior cover 9C in the fourth embodiment is a cover in which the pushing rod opening 32, the guide members 33, and the stoppers 34 in the interior cover 9 in the aforementioned first embodiment are omitted.

A shutter mechanism 11C in the fourth embodiment includes five shutters 86 provided respectively for the five interior cover openings 31 and five shutter supporting shafts 87 provided respectively for the five shutters 86.

The shutters 86 are plate-shaped members which open and close the interior cover openings 31. The shutters 86 are made of a lightweight material such as a resin.

The shutter supporting shafts 87 support the shutters 86 on the back face side (rear face side) of the interior cover 9C such that the shutters 86 are suspended from the shutter supporting shafts 87 and are turnable in the front rear-direction. The shutter supporting shafts 87 are arranged near and above the interior cover openings 31.

In the fourth embodiment, in the state where the fan 10 is not driven, as illustrated in FIGS. 21 and 22, the shutters 86 close the interior cover openings 31 while being suspended parallel to the interior cover 9C. In other words, the shutters 86 are closed when the fan 10 is not driven.

Figure 23:
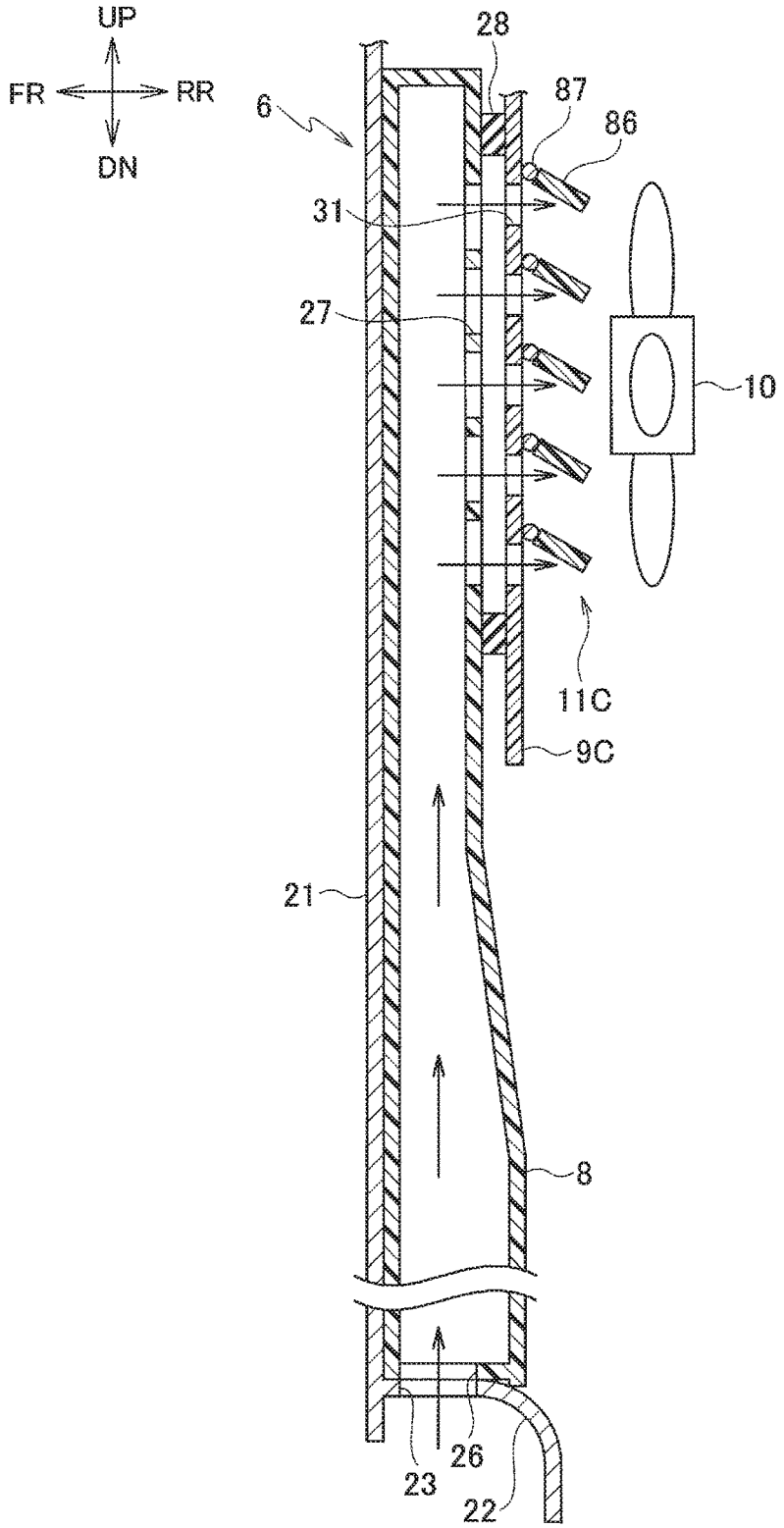
FIG. 23 is a view explaining a flow of air in cooling of the inside of the printing apparatus in the fourth embodiment.

When the fan 10 is driven in the operation of cooling the inside of the printing apparatus 1, wind generated by the drive of the fan 10 pulls the shutters 86 rearward and causes the shutters 86 to turn as illustrated in FIG. 23. The shutters 86 are thereby set to the open state.

The outside air is thereby drawn into the duct 8 from the lower-end opening 26 of the duct 8 as in the first embodiment. The outside air drawn into the duct 8 passes through the duct 8 and then flows to the back side of the interior cover 9C via the front-face openings 27 and the interior cover openings 31. Drawing the outside air into the case 6 as described above cools the inside of the printing apparatus 1.

Also in the fourth embodiment, providing the shutters 86 in the printing apparatus 1 can eliminate limitations on opening dimensions of the interior cover openings 31 as in the first embodiment. Accordingly, also in the fourth embodiment, it is possible to reduce wind noise caused by the interior cover openings 31 and operation noise of the fan 10 and thereby achieve noise reduction as in the first embodiment.

Moreover, since the shutters 86 are opened by the wind generated by the drive of the fan 10, the shutters 86 can be opened and closed in conjunction with the drive of the fan 10 in a simple configuration.

In the aforementioned first to fourth embodiments, description is given of the case where the fan 10 draws air into the case 6 in the cooling operation. However, in the first to third embodiments, the fan 10 may exhaust air from the case 6 or may be switchable between intake and exhaust. Moreover, in the fourth embodiment, the configuration may be such that the shutters 86 and the shutter supporting shafts 87 are arranged on the front face side (forward face side) of the interior cover 9C and the fan 10 exhausts air from the case 6. In this case, the wind generated by the drive of the fan 10 pushes the shutters 86 and thereby opens the shutters 86.

In the aforementioned first embodiment, the configuration is such that the shutter mechanism 11 having the pushing rod 37 opens and closes the shutter 36 in conjunction with the opening and closing of the opening/closing door 21. However, the configuration may be such that the pushing rod 37 and the operated portion 42 of the shutter 36 are omitted and an actuator such as a motor or a solenoid opens and closes the shutter 36. In this case, the actuator is controlled based on the open and closed states of the opening/closing door 21 which are detected by the opening/closing detector 7 to close the shutter 36 when the opening/closing door 21 is open. Also in the second embodiment, the configuration may be such that the pushing rod 58 and the operated portion 62 of the shutter 56 are omitted and an actuator such as a motor or a solenoid opens and closes the shutter 56. In this case, the actuator is controlled based on the open and closed states of the opening/closing door 21 which are detected by the opening/closing detector 7 to close the shutter 56 when the opening/closing door 21 is open.

Embodiments according to the present invention have, for example, the following configurations.

A printing apparatus includes: a case having a door; a duct installed on an inner side of the door in the case and communicating with an outside of the case; a cover installed in the case and having an opening, the opening allowing an inside of the case and the outside of the case to communicate with each other via the duct of the door being closed; a fan configured to perform at least one of drawing of air into the case or exhausting of air from the case via the opening and the duct with the door being closed; and a shutter configured to open the opening during drive of the fan and close the opening while the door is open.

The shutter may close the opening in conjunction with opening of the door.

The shutter receiving wind generated by the drive of the fan may open the opening.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printing apparatus comprising:

a case having a door;

a duct installed on an inner side of the door in the case and communicating with an outside of the case;

a cover installed in the case and having an opening, the opening allowing an inside of the case and the outside of the case to communicate with each other via the duct of the door being closed;

a fan configured to perform at least one of drawing of air into the case or exhausting of air from the case via the opening and the duct with the door being closed; and a shutter configured to open the opening during drive of the fan and close the opening while the door is open.

2. The printing apparatus according to claim 1, wherein the shutter closes the opening in conjunction with opening of the door.

3. The printing apparatus according to claim 1, wherein the shutter receiving wind generating by the drive of the fan opens the opening.

* * * * *